US012604999B2

(12) United States Patent
He

(10) Patent No.: US 12,604,999 B2
(45) Date of Patent: Apr. 21, 2026

(54) SERIES OF FLOWER BASKETS

(71) Applicant: Wei He, Dongguan City (CN)

(72) Inventor: Wei He, Dongguan City (CN)

( * ) Notice: Subject to any disclaimer, the term of this patent is extended or adjusted under 35 U.S.C. 154(b) by 28 days.

(21) Appl. No.: 18/576,743

(22) PCT Filed: Jul. 5, 2021

(86) PCT No.: PCT/CN2021/000141

§ 371 (c)(1),
(2) Date: Jan. 5, 2024

(87) PCT Pub. No.: WO2023/279219

PCT Pub. Date: Jan. 12, 2023

(65) Prior Publication Data

US 2024/0285104 A1 Aug. 29, 2024

(51) Int. Cl.
*A47G 7/08* (2006.01)
*A47G 7/04* (2006.01)

(52) U.S. Cl.
CPC ..... *A47G 7/08* (2013.01); *A47G 7/04* (2013.01)

(58) Field of Classification Search
CPC ..... A01G 9/02; A01G 9/023; A01G 9/024; A01G 9/124; A47G 7/04; A47G 7/041; A47G 7/08; B44C 5/00
USPC ..... 206/423, 457; 47/79
See application file for complete search history.

(56) References Cited

U.S. PATENT DOCUMENTS 7,617,632 B1 * 11/2009 Imm ..... A01G 9/124 47/79
7,802,399 B2 * 9/2010 Shelton ..... A47G 7/041 47/47
7,913,452 B1 * 3/2011 Imm ..... A47G 7/041 47/79
9,877,436 B1 * 1/2018 Taylor ..... A01G 9/023

FOREIGN PATENT DOCUMENTS

CN 201557857 U * 8/2010
CN 209498014 U * 10/2019

* cited by examiner

*Primary Examiner* — Bryon P Gehman
(74) *Attorney, Agent, or Firm* — Li & Cai Intellectual Property Office

(57) ABSTRACT

Multi-purpose and decorative series of flower baskets are provided. The flower baskets each include a bottom basket storage space, a middle concave basket cover flower arrangement space, an external decoration small platform, and a handle. A small-platform type, a flower-like basket edge type, a flower bed and flower lace type, a double-sided mirror frame type, an attractive melon and fruit type, a soft decoration desktop type, a clever collage type and a hard decoration desktop type, are designed by taking the creation of a small decoration platform as a technical concept. The main connection modes involve the basket cover being supported by a frame, relief grooves being fastened together, and double-sided adhesive tape or screws being used for reinforcement. There are various ways of connecting a handle and a basket; and magnetic fasteners, other fixing fasteners, and nuts and studs are mainly selected for fixing.

15 Claims, 4 Drawing Sheets

SERIES OF FLOWER BASKETS

FIELD OF THE DISCLOSURE

The present disclosure relates to the technical field of a flower basket, and more particularly to a multi-purpose decorative series of flower baskets.

BACKGROUND OF THE DISCLOSURE

China is the origin of flower baskets. The traditional handicraft flower basket was originally a concave basket used to hold objects, and mostly made of rattan straw. Later, the flower basket was used to arrange flowers for viewing, or mixed some gifts into the flowers to give to relatives and friends to express one's own feelings or courtesy. The flower baskets have changed from simple shapes to woven patterns with beautiful basket edges. The shape of flower baskets appears in paintings, lanterns, and handicrafts. Flower baskets have become a part of enriching people's lives. Nowadays, not only the Chinese but also people around the world like to use flowers to convey their feelings, beautify their lives, and cultivate their sentiments, and flower baskets are becoming more and more closely related to human life. People use flower baskets to give gifts, decorate, open festivals, comfort patients, and mourn relatives and friends. Flower baskets are increasingly closely related to human life. Although the traditional flower basket has a natural and simple beauty, the current flower basket is just a concave basket with a simple structure, not novel enough, insufficient decorative capacity, monotonous variety, and insufficient stimulation of people's imagination. If it is just a traditional flower basket, the expression of people's feelings or courtesy will be limited, and it cannot fully play the role of relaxing and enjoying life for tired people. Therefore, it is really important to make the flower basket more and more beautiful.

SUMMARY OF THE DISCLOSURE

In view of the above shortcomings, the present disclosure mainly improves in terms of three aspects as follows. 1. The present disclosure provides a series of flower baskets that have a storage space, an open flower arrangement space, one or several small decoration platforms and handles to improve the original simplicity and the lack of novelty. In addition, it is different from the existing stacked packaging boxes and beam boxes and has the open flower arrangement space and the one or several small decoration platforms. Further, frames interconnecting the boxes, or the box and the cover are located outside the boxes, but in the present disclosure, the frames used to interconnect the flower basket and the basket cover are all located in the basket. 2. With the technical concept of creating a small decorative platform, we have designed eight types of flower baskets: frame support small platform baskets, flower leaf basket edge flower baskets, flower bed and lace flower baskets, double-sided mirror frame flower baskets, attractive fruit flower baskets, soft desktop flower baskets, a flower basket that makes up a picture and hard desktop flower baskets: overcoming the shortcomings of the original decorative capacity and monotony. 3. The present disclosure can make full use of the diversity of materials and molding methods to carry out a wide variety of shapes and various modifications. The present disclosure can not only retain the natural and simple beauty of traditional flower baskets, but also add many fashion elements, thereby making the flower baskets contribute to the advancement of fashion and various appearances and colors.

The general technical solution used in the series of flower baskets is as follows. The series of flower baskets are based on a technical concept of the present disclosure, including: a bottom basket storage space, a middle concave basket cover ⊔ -shaped flower arrangement space, a decoration small platform that is configured to be externally added, and a handle. A total of eight flower baskets are provided based on the technical concept of creating a small decoration platform, including: a frame support small platform baskets, a flower leaf basket edge type flower basket, a flower bed and flower lace type flower basket, a double-sided mirror frame type flower basket, an attractive melon and fruit type flower basket, a soft decoration desktop type flower basket, a flower basket that makes up a picture and a hard decoration desktop type flower basket. There are various ways to connect the bottom basket storage space and the middle concave basket cover. The main connection methods are frame support for the middle concave basket cover, interlocking of concave and convex grooves, double-sided tape or screw reinforcement. There are various ways to connect the handle to the bottom basket storage space. The main methods are magnetic buckles, other fixing buckles, screws and studs. The shape and modification of the handle are determined by the inventor.

The following are the technical solutions of the eight series of flower baskets provided by the present disclosure based on the technical concept of creating a small decoration platform.

The structure of the series of flower baskets is a small platform type flower basket. The lower bottom basket is a concave basket, which provides a storage space. The technical feature is that a contour of the bottom basket storage space has an edge that is wider than a basket body. The edge has a shape formed by taking a "⌊" shape as a basic unit to surround an outer periphery of the bottom basket shape. The edge is a frame, and the user needs to determine the dimensions of each edge. If the frame can be provided on the top to play a supporting role, the inside of the frame is hollowed out to make the flower basket erected, so that any shape that is beneficial to manufacturing can be used as a storage space for the bottom basket. The technical feature of the flower basket is that where the bottom basket storage space (1) is not connected or connected in one of a straight line, or connected in one of an arc line, or connected in one of a mixed straight line and arc line, thereby forming a distinctive frame. The circle of edges can be added around the outer periphery of the frame. This edge (8) may be one of turned up, or turned in one of the middle or down, or turned in one of straight or turned in a curled shape. The edges may be decorated in various ways. The inventor determines the size of each side of the edge and uses it as a small platform for frame decoration. The middle layer is a concave basket cover, but the cover is recessed. The recessed shape or side is consistent with and attaches to the shape of the bottom basket, and the bottom surface is mostly flat, or it can be a kind of regular or irregular shape that can enter the basket and is beneficial to manufacturing. The user determines the depth of the recessed part. The upper convex cover is the cover of the two layers below, and is a transparent cover. The color is not limited, and the shape and shape are mostly the same as the middle concave basket cover, but the direction is opposite, or the shape may be changed at will for decoration. The structural feature of the small platform type flower basket is that it has a frame that supports the small decoration platform, and the flower basket may also use a ⅃-shaped or a "▬"-shaped bottom basket as the frame. Because in the existing flower basket, a classical bowl-shaped flower basket has this kind of frame, but is not a shelf and has a previous shape.

The structure of the series of flower baskets is the small platform type flower basket, and the bottom basket storage space and middle concave basket cover of the small platform type flower basket have a unique connection. A side of a middle concave basket cover has a same shape as a top of the bottom basket storage space, a bottom surface is flat and a surrounding edge or a ⅃-shaped surrounding edge or a ⅃-shaped surrounding edge vertical to the middle concave basket cover is provided on the middle concave basket cover to be placed on the frame of the bottom basket storage space. The upper convex cover is placed on the edge of the bottom basket storage space and the middle concave basket cover. The upper convex cover has a supporting edge, and the supporting edge may be connected to the cover, or is designed in another way to be glued to the middle concave basket cover. In order to adapt to the arrangement of the handle, a small semicircle or square is dug out on the edge of the upper convex cover near the handle, or no dug is left. This frame allows the middle concave basket cover and the upper convex cover to be combined to form an open flower arrangement space. The connection method between the handle and the bottom basket storage space is: using a magnetic buckle or a T-shaped buckle on both sides of the handle to pass through the hole on the storage space frame of the bottom basket and the hole on the handle and the hole on the middle concave basket cover, and covering it with a plastic sleeve with an edge between the bottom basket storage space frame and the edge of the middle concave basket cover. If it is unstable, the user can use double-sided tape or screws to reinforce it.

The lower bottom basket of the flower-like basket edge type flower basket of the series of flower baskets is a concave basket, which provides a storage space. The technical feature is that the shape of the bottom basket storage space has an edge that is wider than the basket body. The edge is a shape formed by taking a "L" shape or a ⅃ shape or ""—" " shape as the basic unit to surround the outer periphery of the bottom basket storage space. The edge is a frame. The user can determine the dimensions of each edge according to needs. The interior of the frame is hollowed out so as to make the flower basket erected, and the shape that is beneficial to manufacturing can be used as a storage space for the bottom basket. The middle part of the middle concave basket cover having a flower-like shape of the flower-like basket edge type flower basket is a concave basket cover, and a shape of the concave basket cover is determined by the user. Two or more petals or flowers or leaves or branches are connected to an outside of the cover, the two or more petals or flowers or leaves or branches are either a same size or spaced apart, a whole or part and a shape, a color and a type of the two or more petals or flowers or leaves or branches are uniform or non-uniform, and the middle concave basket cover is smaller than and higher than the frame. An upper layer flower-like concave basket cover of the flower-like basket edge type flower basket or a concave basket in a flower-like vertical frame is smaller than and higher than a middle layer, and a periphery is also connected with two or more petals or flowers or leaves or branches and leaves. A shape, a number and a distribution of the two or more petals or flowers or leaves or branches and leaves are consistent with each other or slightly less than those on the middle concave basket cover having the flower-like shape, or slightly smaller or a same size as the leaves on the middle concave basket cover having the flower-like shape, and shapes thereof are determined by the user according to needs, such as shapes that are turned up or down or horizontal or connected or layered or turned over or a mixture of the method mentioned above, and patterns and shapes are customized by the user according to the needs, or slightly exaggerates, personifies, or imitates things. The bottom of the upper layer flower-like concave basket cover is removed and turned into a vertical plug or bent into a groove or a flat surface so as to form the mosaic-leaf vertical frame. One to five layers of flower-like concave basket covers are added to the upper layer flower-like concave basket cover or the flower-like vertical frame in sequence according to the upper layer or the middle layer, such as a number of flowers outside a cover edge is reduced each layer, the flower-like concave basket cover or a flower-like vertical frame is higher in one layer than another layer, or a number of flowers outside a cover edge is smaller in shape than each other, or the flower-like concave basket cover or the flower-like vertical frame is higher in one layer than another layer. The above forms a small platform with a basket of flowers and leaves and a flower arrangement space. In short, the structural feature of the series of flower baskets is that the basket supports the basket cover, the basket cover supports the basket cover, and the basket cover is connected to the basket edge with flowers or leaves.

The frame and cover, and the basket and basket cover of the flower-like basket edge type flower basket of the series of flower baskets can be connected in various ways, such as vertical plugs and sockets, and pasting. Distinctive features include grooves on the frame and the middle concave basket cover having the flower-like shape, which interlock with each other. Grooves are provided on the middle concave basket cover having the flower-like shape and the upper concave basket cover having the flower-like shape that interlock with each other. The handles are on both sides or on both sides of the basket. The user determines the connection method. It is common to use a magnetic buckle or a T-shaped buckle to pass through the hole on the bottom basket storage space and the hole on the handle, and cover it with a plastic sleeve with an edge. If it is blocked with a leaf, holes can be provided on the leaf.

The lower bottom basket of the flower bed and flower lace type flower basket of the series of flower baskets is a concave basket, which provides a storage space. The technical feature is that its opening can cover and fix a middle cover with an opening in the middle as described below. Any shape that satisfies the above conditions, has a hollow interior that allows the flower basket to stand upright, and is beneficial to manufacturing can be used as a storage space for the bottom basket. The middle cover is a technical feature different from traditional flower baskets. The key to the technology is that the central opening of the cover body can be one of circular, quadrilateral, heart-shaped, flower-shaped or simple symmetrical. The criteria for selecting the above-mentioned shapes should be the benefit for manufacturing. The user determines the shape of the middle cover, which plays a role in supporting the upper layer. The vertical concave basket is also called the middle concave basket cover, which forms an open flower arrangement space; and the outer surface of the vertical concave basket is designed as a stepped flower bed. that is, the ⅃ shape is used as a most basic unit to form a same shape as the concave basket of a vertical body, then an outer upper part of the vertical concave basket is made of one or more such shapes, one is lower and larger than another in a ladder connection manner, the front end and the rear end are connected together, a dimension of each layer and each surface are determined by the user, and each surface size of one or more layers is the same or different. On a basis of the flower bed, a lace decoration is added to form a stepped flower lace. When adopting a gluing method, the vertical edge is added to the neighboring edge or the support is added. An outside of the vertical concave basket forms a flower bed and flower lace type decoration platform. The present stepped flower bed is different from the existing landscape terrace flower bed since the bottom of the existing landscape terrace flower bed is flat or hollow. It is possible to use the existing landscape terrace flower bed in the present stepped flower bed because it is the first time to use it for baskets and the shape is an old one. A brief introduction to the structural features of the flower basket is that outside the vertical concave basket, there is a flower bed and a small lace-style decoration platform composed of a ⅃ shape as the basic unit.

The flower bed and lace-style flower baskets of the series has special features such as: a vertical edge is added to the edge of the middle cover, and the design is a shallow convex middle cover, which is a shallow ⊓ shape, and the bottom basket storage space is equipped with side shallow grooves on the sides, which snap into place with the side shallow convex grooves on the sides of the middle cover. The side grooves can be arranged flexibly. If it is not enough, additional double-sided tape or screws can be added to fix it. The common method of connecting the handle to the flower basket is as follows. After the bottom basket storage space and the middle cover are fastened together through the concave and convex grooves, a magnetic buckle or a T-shaped buckle is used to pass through the hole on the bottom basket storage space and the hole on the handle, and a magnetic buckle or a plastic sleeve with an edge is used to insert it from the middle opening of the middle cover to fix it. If it is not firm, the user can add double-sided tape and screws to fix it. If the area of the stepped flower bed and stepped flower lace exceeds the bottom basket storage space, the part that originally held the handle is used to fix the bottom basket storage space and the middle cover using the usual method. The handle is moved to the depression at the top of the upper concave basket, and the fixing method is the same as before. The connection between the middle cover and the vertical concave basket has special features such as: grooves are provided around the middle opening of the middle cover that interlocks with the convex grooves at the bottom of the vertical concave basket. If it is not firm, it can be fixed with double-sided tape.

The lower bottom basket of the double-sided mirror frame type flower basket of the series of flower baskets is a concave basket, which provides a storage space. The technical feature of the technology is that its opening can cover and fix a middle concave basket cover with a concave opening as described below. Any shape that satisfies the above conditions and has a hollow interior that allows the flower basket to stand upright and is beneficial to manufacturing can be used as a bottom basket. The middle concave basket cover is a technical feature different from traditional flower baskets. The technical feature is that a concave opening is provided in the middle of the main body of the middle concave basket cover. The openings are mostly rectangular or similar rectangular polygons or other regular or irregular polygons which are convenient for manufacturing. The two middle edges of the opening can be straight edges or folded edges or arced edges or straight edges, arced edges, or folded edges that are optionally joined, the two sides for installing the handle extend downward into a shape. This shape can be combined with the lower parts of both sides of a third part of the handle, and is beneficial to manufacturing and does not affect the installation of the handle. The lower part does not seal, and the user needs to determine the shape of the middle concave basket cover. Nothing can be added to the concave opening, and flowers can be placed directly inside or some pictures and handicrafts can be added, but it must be fixed within the vertical range of the concave opening. The user can also add a matching polygonal basket to the fixed handle, without a cover. The polygonal basket has no edges, and is fixed with holes together with the handle. If there are edges, the edges are used to rest on the middle concave basket cover. A support body can be added to the inside of the handle for support, and the concave opening provides a part of the flower arrangement space. The handle is an important technical feature that distinguishes it from traditional flower baskets. The handle is open on the inside or outside or on both sides or one or more sides, has a certain height and width, that is, can form a flower arrangement space, is the outline or most of the outline of the plan view of a tangible object, or is solid. The lower part can be deformed or the main trunks on both sides can be extended downward. The shape is a shape that can be brought together with the two sides extending downwards of the mounting handle and can finally be inserted into the concave opening and fixed, in order to facilitate manufacturing. It also forms part of the flower arrangement space and a double-sided mirror frame-type decorative handle. A hand guard can be added to the top, and it can be used for various decorations. This frame is different from ordinary mirror frames and characterized by a double-sided mirror frame flower basket with a double-sided mirror frame as a handle installed in the concave opening of the central concave basket cover.

The unique connection method of the double-sided mirror frame type flower baskets of the series of flower baskets is as follows. A side vertical to the side of the middle concave basket cover is added, and the design is a shallow convex middle concave basket cover, that is, a shallow ⊓ shape. The bottom basket storage space is equipped with side shallow grooves on the sides, which snap into the side shallow convex grooves on the sides of the middle concave basket cover. If it is not enough, the user can add double-sided tape or screws to fix it. The connection method between the handle and the concave opening is not the technical key to this flower basket. There are many methods. For example, the outer edges on both sides of the bottom of the handle are designed to be quadrangular or arc-shaped or similar, and the two sides are removed and the concave basket cover is embedded in the middle. Then a magnetic buckle or a T-shaped buckle is used to pass through the hole on the middle concave basket cover and the hole on the handle, and a plastic sleeve with an edge is used to cover it. The double-sided tape or screws can be used to fix it.

The double-sided framed flower baskets of the series can also be configured to be transformed into a box. When a transparent thin plastic sheet is correspondingly installed on both sides of the handle, the double-sided mirror frame type flower basket is transformed into a box without sealing the bottom, or a convex groove is provided inward on all sides to be embedded in a "U" shaped frame with a same shape as a bottom basket or in a groove around the "U" shaped frame. The transparent thin plastic sheet is decorated in a plurality of ways, mainly by printing, relief, stickers, and openwork carving.

The attractive melon and fruit style flower basket of the series of flower baskets has a concave bottom basket, which provides a storage space. The technical feature is that the middle part of the bottom basket storage space of the attractive melon and fruit type flower basket is a bottom part of a melon and fruit shape, a bottom edge of the melon and fruit extends outward into one of square, circle, flower shape, leaf shape and other various shapes, or further downwards to form a ⅃ shape, or both sides are inclined inward or outward. The above-mentioned shapes should be beneficial to manufacturing, and the user determines the size. A small decoration platform is formed. There is an edge on the storage space of the bottom basket that is slightly wider than the side that is higher than the basket body. It is a ⅃ -shaped frame or a "L"-shaped frame or a "—" -shaped frame. The user determines the dimension of the edge, and the edge is another small decoration platform. The middle part is the concave basket cover. The concave shape of the side is consistent with the top shape of the bottom basket and attaches thereto. The bottom surface is mostly flat, or the user determines the shape. But it can fit into the bottom basket. The user determines the depth according to the situation, this is, a flower arrangement space. The upper layer is the cover of the lower two layers, and is the transparent cover, and the color is determined by the user. The upper layer is convex shape, and is referred to as the upper convex cover. The shape is the other half of the melon and fruit shape, and it cooperates with the bottom basket to form a cut melon shape of the fruit placed on an object, which is very attractive. There is a supporting edge around the upper convex cover. The supporting edge is either on the upper convex cover or separately glued to the middle concave basket cover. The user determines the size. This is the third small decoration platform. The technical feature of the flower basket is that: the upper basket and the bottom basket are combined into the shape of a cut melon and fruit placed on the object, making it a very attractive melon and fruit style flower basket.

The attractive melon and fruit style flower basket in the series of flower baskets has special connections such as: the side of the middle concave basket cover has the same shape as the top of the bottom basket. It can be designed to add an edge or an "L"-shaped edge or a ⅃ -shaped edge vertical to the middle concave basket cover and placed on the frame of the bottom basket. The upper convex cover is placed on the edge of the bottom basket storage space and the middle concave basket cover. There is a supporting edge around the upper convex cover. The supporting edge can be provided on the cover, or it can be designed separately and glued to the middle concave basket cover. A small semicircle or square can be provided on the edge of the upper convex cover by the handle so as not to conflict with the handle. This frame allows the middle concave basket cover and the upper convex cover to be combined into an open flower arrangement space. The handles are on both sides. A magnetic buckle or a T-shaped buckle is used to pass through the hole on the frame of the bottom basket storage space, the hole on the handle and the hole on the middle concave basket cover, and a plastic sleeve with an edge is used to covered it on the outer edge of the frame of the bottom basket storage space and the edge of the middle concave basket cover. If it is unstable, the double-sided tape or screws can be used to reinforce it.

The lower bottom basket of the series of the soft decoration desktop type flower basket is a concave basket, which provides a storage space. The technical feature of the series of flower baskets is that: a circular edge that is slightly wider than a side of the basket body is provided on the bottom basket storage space of the soft decoration desktop type flower basket, the circular edge is a ⅃ -shaped frame, or a ⅃ -shaped frame or a "—" -shaped frame, and the user determines the size of the edge of the frame, and the concave shape that can be attached to the frame to facilitate manufacturing can be used as a storage space for the bottom basket. The middle part is the middle concave basket cover. A concave shape in a middle of the middle concave basket cover is either directly placed on the frame parallel to a bottom surface of the frame, or sides thereof are consistent with and attaches to an upper part of the bottom basket storage space, or is fitted into the bottom basket according to the decoration, and a depth of the concave shape is determined by the user according to a situation. A bottom is like a desktop and called a flat desktop, a middle part is a plane, or an opening is provided on the plane and the opening on the plane can be configured for an insertion of an object. The object is formed independently and then inserted into the hole or connected to a desktop to form an integrated body, and any object which is beneficial to manufacturing and able to be used as a flower arrangement space and connected to the desktop is the object. An edge of the flat desktop of the soft decoration desktop type flower basket is a ⅃ -shaped frame and a ⅃ -shaped frame, or a ⅃ -shaped frame or a "—" -shaped frame that are consistent with and attach to each other. A highest outer side of a desktop side is connected by straight lines or arcs or a mixture of straight lines and arcs, and is a same size as or wider than a highest side of the frame. An edge is added to an outermost edge of the desktop, that is, an outermost edge, or the outermost edge is vertical to a highest edge of the desktop or closely connected to a highest edge to create a non-vertical shape, and a size thereof is determined by the user. A support is provided to support a peripheral soft decoration lace, and cloth and a cloth-like soft decoration are inserted or pasted on an outer surface of an entire middle concave basket cover, and the above are collectively referred to as the soft decoration desktop type flower basket. Its structural features are that the desktop edge of the middle concave basket cover, the flat desktop, a shape body and the outermost edge form a soft decoration desktop flower basket that decorates a small platform.

The soft decoration desktop type flower basket of the series of flower baskets has various connection methods. The distinctive features include that: the bottom surface of the middle concave basket cover is a flat desktop, the edge of the flat desktop is consistent in shape with the frame of the bottom basket storage space, and is placed on the ⅃ -shaped frame or the "L"-shaped frame in the bottom basket storage space. The handle is installed on the soft table top on both sides. The common method is to fix them with screws. If it is unstable, the double-sided tape or screws can be used to reinforce them around the edges.

The clever collage type flower basket of the series of flower baskets has a concave bottom basket, which provides a storage space. The technical feature is that two sides of the bottom basket storage space of the clever collage type flower basket are a lower half of a painting, which is a small decoration platform. An edge that is slightly wider than the basket body is provided on the bottom basket storage space. The edge is a ⅃ -shaped frame, or a ⅃ -shaped frame or a "—" -shaped frame. The frame is only a quadrilateral, with straight edges, curved edges, or folded edges, and a size of the edge is determined by the user. The edge is a second small decoration platform. The middle part is the concave basket cover. The concave shape of the side is consistent with the top shape of the bottom basket and attaches thereto, or the bottom can be put into the bottom basket storage space as needed. The user determines the depth of the recessed part according to the situation, this is, a flower arrangement space. The upper layer is the cover of the lower two layers, and is the transparent cover, and the color is determined by the user. The upper layer is convex shape, and is referred to as the upper convex cover. The technical feature is that the shape of the two sides is the upper half of a painting, which is combined with the bottom basket storage space to form a picture. The upper convex cover has a supporting edge. The supporting edge can be directly attached to the upper convex cover, or can be separately glued to the middle concave basket cover. The user determines the size. A painting is a flat painting or a relief painting or an openwork painting, which is also a small decoration platform. The bottom basket storage space, the middle concave basket cover, and the two sides of the upper convex cover, that is, the two sides of the handle, may be flat, diagonally straight, arc-shaped, or undulating with the edges of the painting. The user can make some small decorations at will. The above features a clever collage type flower basket with upper and lower baskets forming a picture.

The clever collage type flower basket of the series of flower baskets is connected in a unique way. The edge of the middle concave basket cover has the same shape as the top of the storage space of the bottom basket, and the user can add a "L"-shaped edge or a ⅃ -shaped edge vertical to the middle concave basket cover and place it on the frame of the bottom basket storage space. The upper convex cover is placed on the surrounding edge of the bottom basket storage space and the middle concave basket cover. In order not to conflict with the handle, a small semicircle or square can be provided on the upper convex cover adjacent to the handle. This frame allows the middle concave basket cover and the upper convex cover to be combined into an open flower arrangement space. The handles are on both sides, and a magnetic buckle or a T-shaped buckle is used to pass through the hole on the frame of the bottom basket storage space, the hole on the handle and the hole on the middle concave basket cover, and a plastic sleeve with an edge is used to cover it on the outer edge of the frame of the bottom basket storage space and the edge of the middle concave basket cover. If it is unstable, the user can use double-sided tape or screws to reinforce it.

The lower bottom basket of the hard decoration desktop type flower basket of the series of flower baskets is a concave basket, which provides a storage space. The technical feature is that an edge that is slightly wider and higher than the basket body is provided on the bottom basket storage space of the hard decoration desktop type flower basket, the edge is either a ⅃ -shaped frame or a "L"-shaped frame or a "—" -shaped frame, and a size of the edge of the frame is determined by the user. Each surface or plane of the frame or a groove is used for fixation and decoration. A concave shape in a middle of the middle concave basket cover is either directly placed on the frame parallel to a bottom surface of the frame, or sides thereof are consistent with and attach to an upper part of the bottom basket storage space, or are fitted into the bottom basket according to the decoration, and a depth of the concave shape is determined by the user according to a situation. A bottom is like a desktop and called a flat desktop, a middle part is either a plane, or an opening is provided on the plane and the opening on the plane can be configured for insertion of an object. The object is formed independently and then inserted into a hole or connected to a desktop to form an integrated body, and any object which is beneficial to manufacturing and able to be used as a flower arrangement space and connected to the desktop is the object. An edge of the flat desktop of the soft decoration desktop type flower basket is a ⅃ -shaped frame and a ⅃ -shaped frame, or a ⅃ -shaped frame or a "—" -shaped frame that are consistent with and attach to each other. A highest outer side of a desktop side is connected by straight lines or arcs or a mixture of straight lines and arcs, and is a same size as or wider than a highest side of the frame. An edge is added to an outermost edge of the desktop, that is, an outermost edge, or the outermost edge is vertical to a highest edge of the desktop or closely connected to a highest edge to create a non-vertical shape, and a size thereof is determined by the user. The entire desktop and the vertical sides of the desktop are decorated directly on the material, so it is called a hard decoration desktop. Each side or plane of the frame may be equipped with grooves that are convenient for manufacturing for fixing and decoration. Its structural features are that the desktop edge of the middle concave basket cover, the flat desktop, a shape and the outermost edge form a hard decoration desktop that decorates a small platform.

The hard decoration desktop type flower basket of the series of flower baskets has technical features such as: the bottom surface of the middle concave basket cover is a flat desktop. The outer edge of the flat desktop is consistent with the shape of the bottom basket storage space frame and placed on the ⅃ -shaped frame or the "L"-shaped frame in the bottom basket storage space. The handle is installed on both sides of the hard decoration desktop, on top or on the side. The common method is to fix it with screws. If it is unstable, the user can use double-sided tape or screws to reinforce it around the perimeter.

The materials used for the series of flower baskets include plastic, paper, leather, rattan or other shapeable materials. The series of flower baskets can be produced by injection molding, blister molding, thermoforming, box gluing, and other methods used to shape handicrafts. In addition to decorating the flower arrangement space, the series of flower baskets can be decorated with printing, stickers, reliefs, openwork carving, pasting aids and other currently available crafts to decorate the small platform and storage space. The combination of the three manners as mentioned is like the icing on the cake. The various shapes are refreshing, the decorative content is rich and colorful, and the decorative style is more modern. A new realm of floral art starts. The series of flower baskets can be used for gift packaging, festival celebrations, birthday commemorations, couples and relatives conveying feelings, decorative storage and other useful places. The possible uses include modifying the flower baskets to drill holes for flower arrangement and planting, making one side flat as wall decorations, making soft handles as hanging decorations, hand-made, adding electronic devices, lighting, sewing boxes, kitchen utensils, storage boxes, hand bouquet packaging, bag. Compared with the packaging on the market, the series of flower baskets has more open flower arrangement space and a small decoration platform. Even the external functions of the storage space are different. Therefore, the series of flower baskets is different from existing packaging boxes and bags, but it has the functions of boxes and bags. The series of flower baskets has the same effect as New Year lanterns, couplets, and Christmas gifts and decorations, but the decoration style is more elegant and the function is wider. The variety and distinctive styles of the flower baskets designed around the basic structure of the eight flower baskets in the series of flower baskets indicate that the series of flower baskets is distinctive and unique. The series of flower baskets is simple to make, has high or low cost levels, and has broad market prospects.

DETAILED DESCRIPTION OF THE EXEMPLARY EMBODIMENTS

Figure 1:
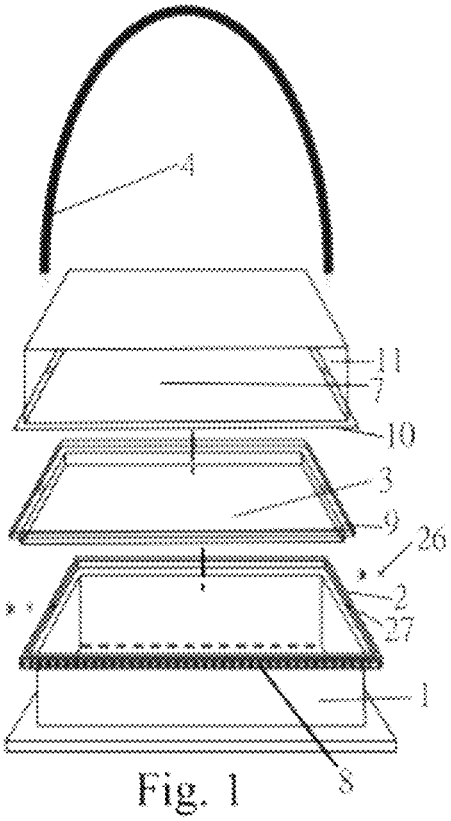
FIG. 1 is a schematic structural diagram of a small platform type flower basket of a series of flower baskets.
Figure 2:
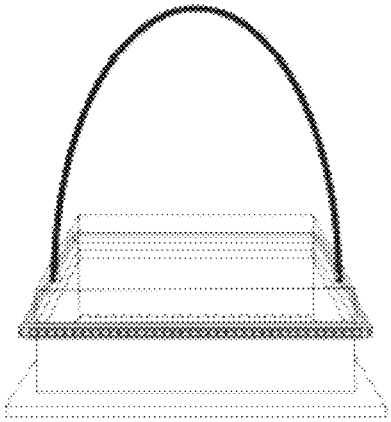
FIG. 2 is an overall view of the small platform type flower basket of the series of flower baskets.

In FIG. 1: 1, bottom basket storage space; 2, ⅃-shaped frame or "L"-shaped frame; 25, frame; 3, middle concave basket cover; 4, handle; 26, magnetic buckle or T-shaped buckle or plastic sleeve with an edge; 27, hole; 7, upper convex cover; 8, edge; 9, surrounding edge; 10, supporting edge; 11, small semicircle or square.

Figure 3:
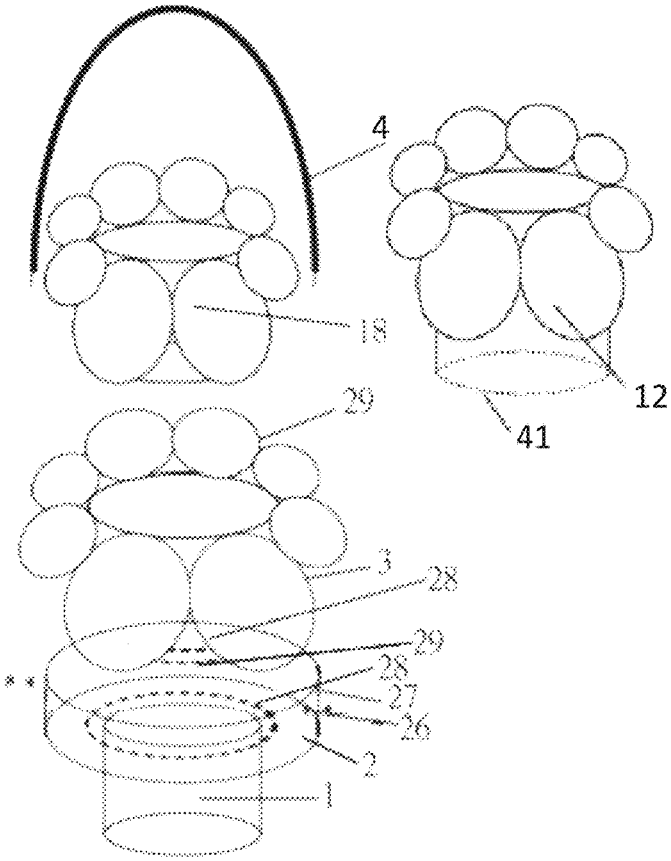
FIG. 3 is a schematic structural diagram of a flower-like basket edge type flower basket of the series of flower baskets.
Figure 4:
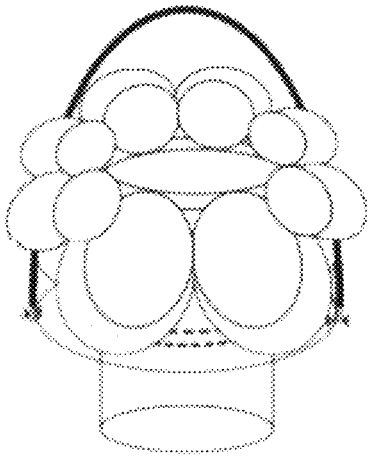
FIG. 4 is an overall view of the flower-like basket edge type flower basket of the series of flower baskets.

In FIG. 3: 1, bottom basket storage space; 2, ⅃-shaped frame or "L"-shaped frame; 28, groove; 3, middle concave basket cover; 29, convex groove; 28, groove; 18, upper layer mosaic-leaf type concave basket cover; 29, convex groove; 4, handle; 26, magnetic buckle or T-shaped buckle or plastic sleeve with an edge; 27, hole; 12, mosaic-leaf vertical frame.

Figure 5:
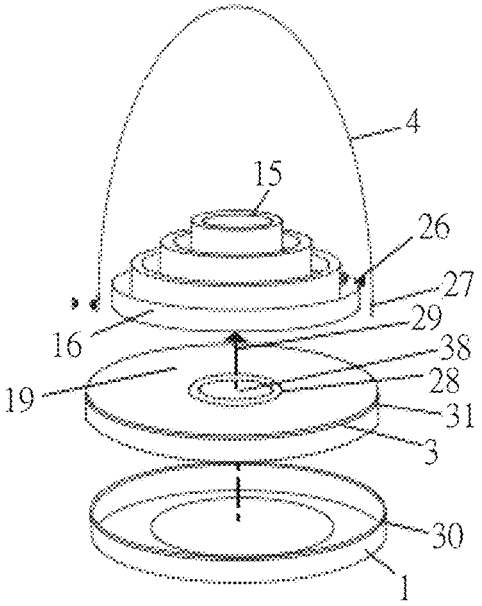
FIG. 5 is a schematic structural diagram of a flower bed and flower lace type flower basket of the series of flower baskets.
Figure 6:
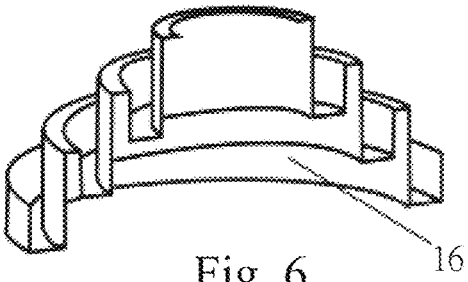
FIG. 6 is a front cross-sectional view of a peripheral flower bed of the flower bed and flower lace type flower basket of the series of flower baskets.
Figure 7:
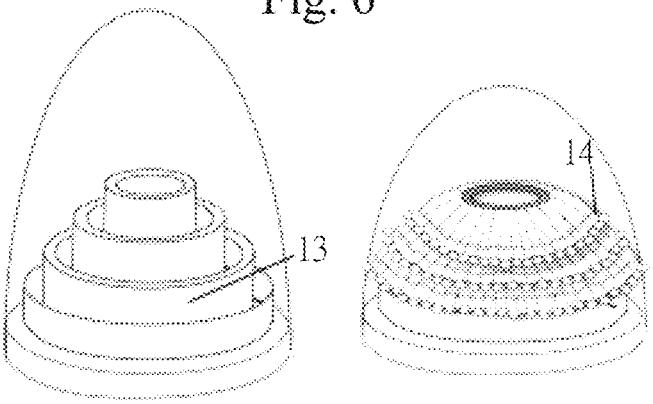
FIG. 7 is an overall view of the flower bed and flower lace type flower basket of the series of flower baskets.
Figure 9:
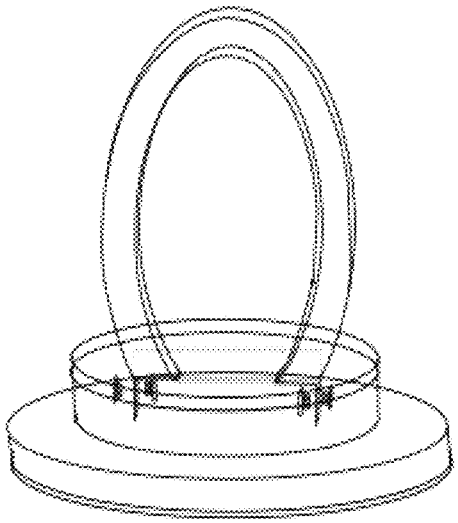
FIG. 9 is an overall view of the double-sided mirror frame type flower basket of the series of flower baskets.

In FIGS. 5 and 6: 1, bottom basket storage space; 30, shallow groove; 3, middle concave basket cover; 31, side shallow convex groove; 19, middle cover; 4, handle; 26, magnetic buckle or T-shaped buckle or plastic sleeve with an edge; 27, hole; 28, groove; 38, opening; 29, convex groove; 16, flower bed and flower lace type decoration platform; 13, stepped flower bed type; 14, stepped flower lace type; 15, vertical concave basket.

Figure 8:
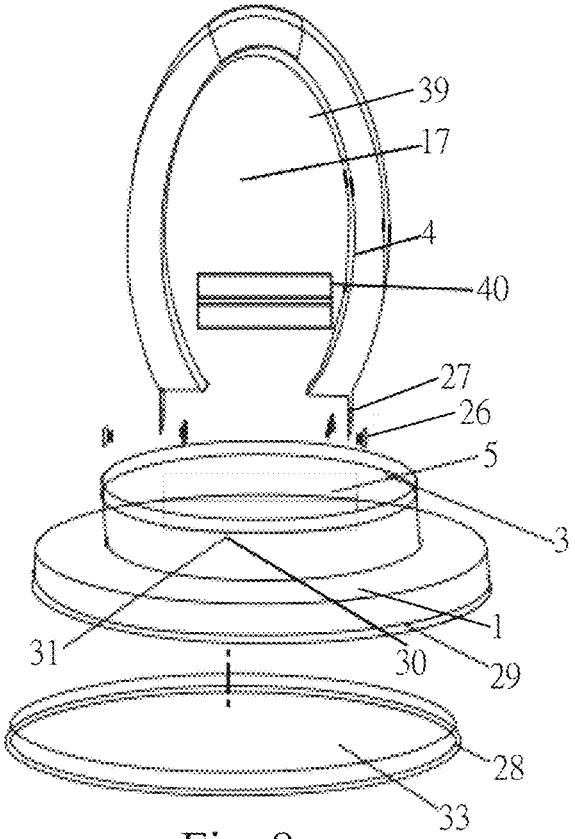
FIG. 8 is a schematic structural diagram of a double-sided mirror frame type flower basket of the series of flower baskets.

In FIG. 8: 1, bottom basket storage space; 30, shallow groove; 31, side shallow convex groove; 3, middle concave basket cover; 5, concave opening; 4, double-sided mirror frame handle; 26, magnetic buckle or T-shaped buckle or plastic sleeve with an edge; 27, hole; 39, hand guard; 40, polygonal frame; 17, transparent thin plastic sheet; 29, convex groove; 33, "U"-shaped frame; 28, groove.

Figure 10:
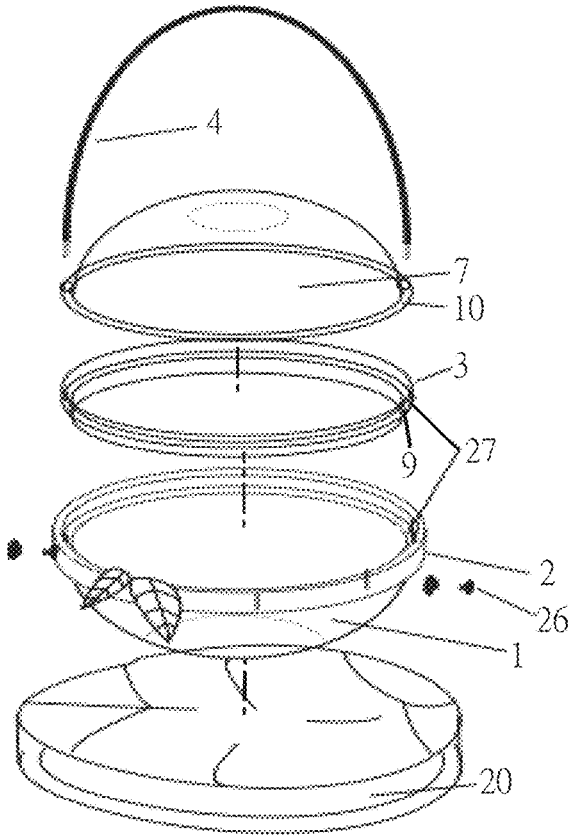
FIG. 10 is a schematic structural diagram of an attractive melon and fruit type flower basket of the series of flower baskets.

In FIG. 10: 1, bottom basket storage space; 2, ⅃-shaped frame or "L"-shaped frame; 3, middle concave basket cover; 9, surrounding edge; 26, magnetic buckle or T-shaped buckle or plastic sleeve with an edge; 4, handle; 27, hole; 20, ⅂-shaped; 7, upper convex cover; 10, supporting edge.

Figure 12:
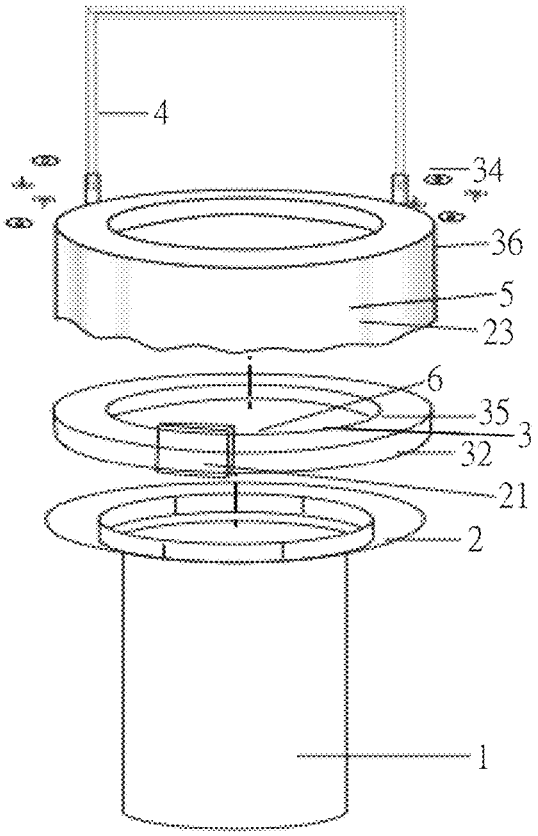
FIG. 12 a schematic structural diagram of a soft decoration desktop type flower basket t of the series of flower baskets.
Figure 11:
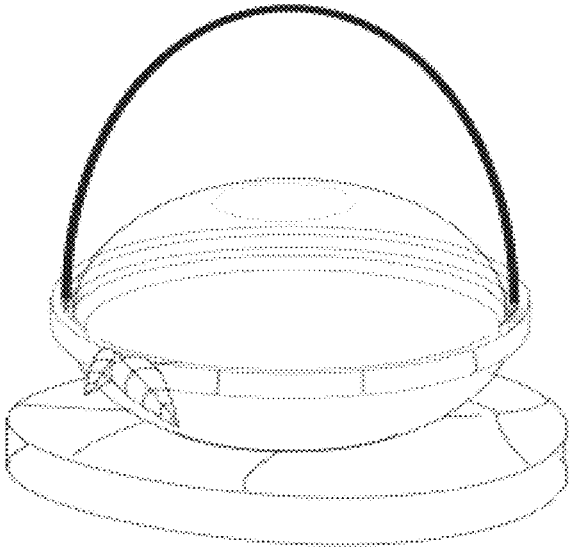
FIG. 11 is an overall view of the attractive melon and fruit type flower basket of the series of flower baskets.
Figure 13:
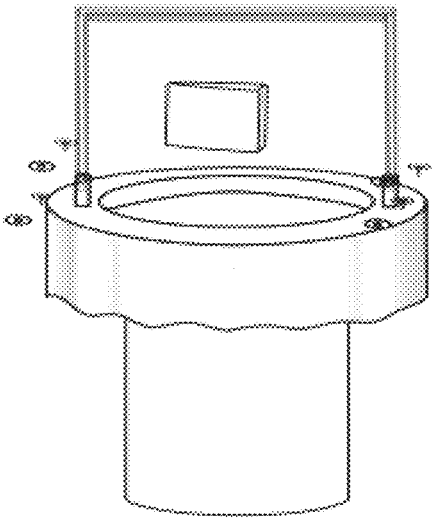
FIG. 13 is an overall view of the soft decoration desktop type flower basket of the series of flower baskets.

In FIG. 12: 1, bottom basket storage space; 2, ⅃-shaped frame or "L"-shaped frame; 3, middle concave basket cover; 32, support; 23, soft desktop; 6, flat desktop; 21, a shape that is beneficial to manufacturing and non-infringement; 4, handle; 34, screws; 35, desktop edge; 36, cloth or cloth-like material.

Figure 14:
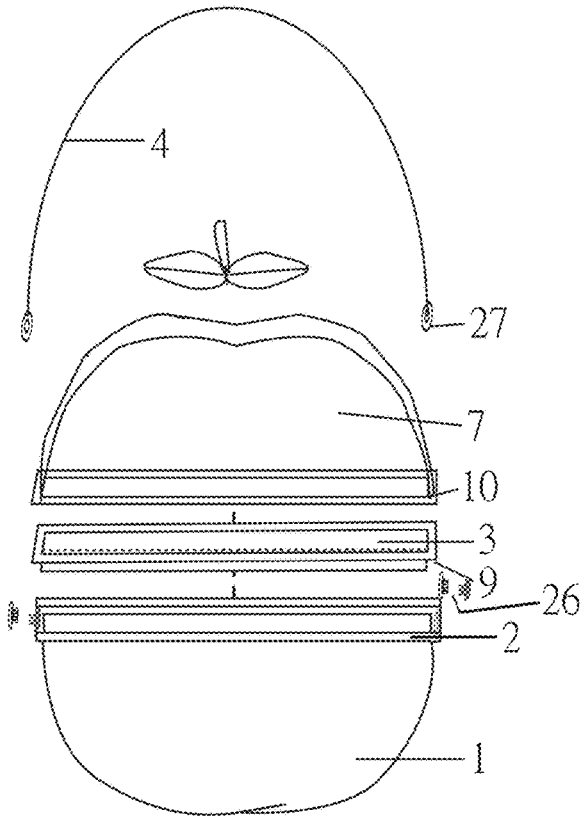
FIG. 14 is a schematic structural diagram of a clever collage type flower basket of the series of flower baskets.

In FIG. 14: 1, bottom basket storage space; 2, ⅃-shaped frame or "L"-shaped frame; 3, middle concave basket cover; 9, surrounding edge; 26, magnetic buckle or T-shaped buckle or plastic sleeve with an edge; 4, handle; 27, hole; 7, upper convex cover; 10, supporting edge.

Figure 16:
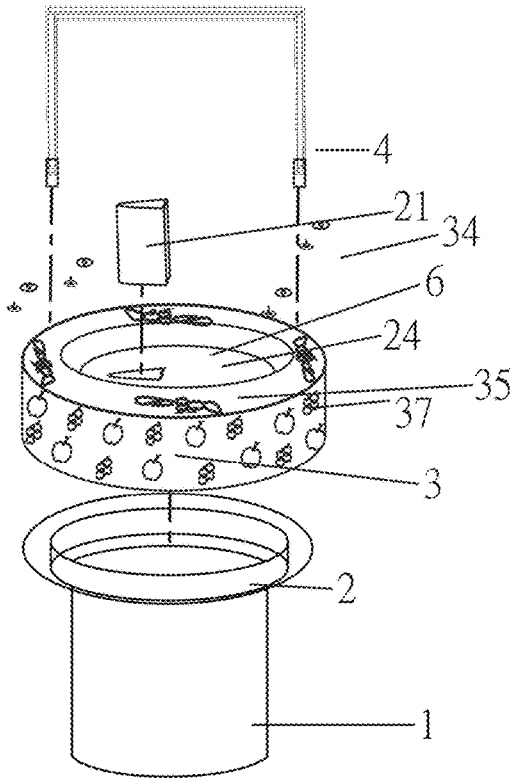
FIG. 16 is a schematic structural diagram of a hard decoration desktop type flower basket of the series of flower baskets.
Figure 15:
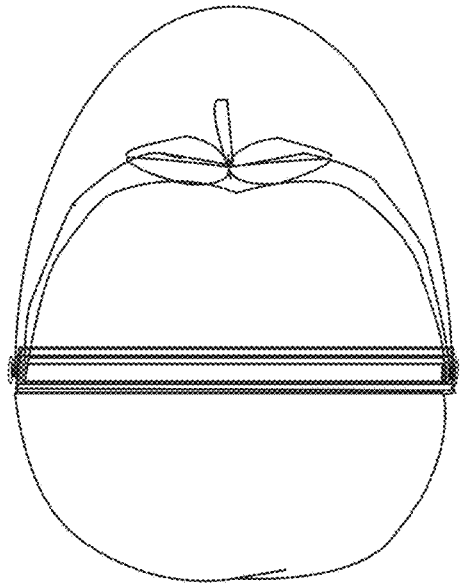
FIG. 15 is an overall view of the clever collage type flower basket of the series of flower baskets.
Figure 17:
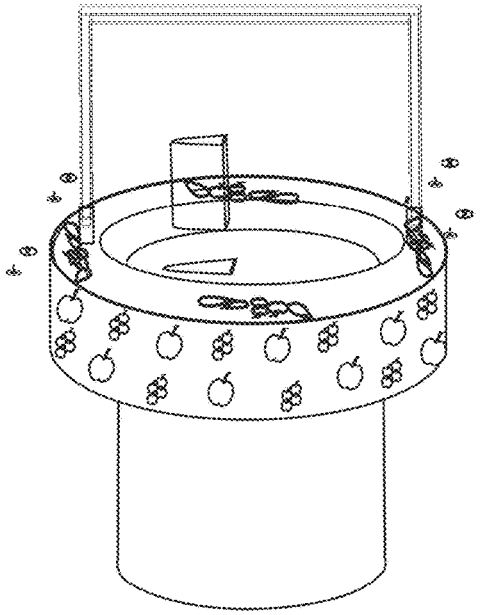
FIG. 17 is an overall view of the hard decoration desktop type flower basket of the series of flower baskets.

In FIG. 16: 1, bottom basket storage space; 2, ⅃-shaped frame or "L"-shaped frame; 3, middle concave basket cover; 37, outermost edge; 6, flat desktop; 24, hard decoration desktop; 21, a shape that is beneficial to manufacturing and non-infringement; 4, handle; 34, screws; 35, desktop edge.

Referring to FIG. 1, an upper side ⅃-shaped frame or "L"-shaped frame 2 and an edge 8 of a bottom basket storage space 1 form a small decoration platform and attach to a surrounding edge 9 of a middle concave basket cover 3. A magnetic buckle or T-shaped buckle 26 is fitted with the plastic sleeve with an edge 26 through the bottom basket storage space 1, the middle concave basket cover 3, and a hole 27 of the handle 4. A supporting edge 10 of an upper convex cover 7 is placed on the ⅃-shaped frame or "L"-shaped frame 2 of the bottom basket for storage and the surrounding edge 9 of the middle concave basket cover 3. In order not to block the handle 4, a small circle shape or square 11 is provided or not provided on the edge of the upper convex cover 7 adjacent to the handle 4.

Referring to FIG. 3, a groove 28 of the ⅃-shaped frame or "L"-shaped frame 2 of the bottom basket storage space 1 supports a convex groove 29 of the middle concave basket cover 3, and the groove 28 of the middle concave basket cover 3 supports the convex groove 29 of the upper layer flower-like concave basket cover 18. A magnetic buckle or a T-shaped buckle 26 is used to pass through the holes 27 on both sides of the ⅃-shaped frame or the "L"-shaped frame 2 of the bottom basket storage space 1 and the holes 27 on both sides of the handle 4, and a plastic sleeve with an edge 26 is used to fix. The ⅃-shaped frame or the "L"-shaped frame 2 of the bottom basket storage space 1 is slightly larger than the middle concave basket cover 3, and the middle concave basket cover 3 is larger than the upper layer mosaic-leaf type concave basket cover 18. The middle concave basket cover 3 is slightly higher than the ⅃-shaped frame or the "L"-shaped frame 2 of the bottom basket storage space 1, and the upper layer mosaic-leaf type concave basket cover 18 is slightly higher than the middle concave basket cover 3. The reference numeral 12 is the flower-like vertical frame.

Referring to FIG. 5 and FIG. 6, a shallow groove 30 on the side of the bottom basket storage space 1 is fastened with a side shallow convex groove 31 on the side of a middle cover 19, and then a magnetic buckle or T-shaped buckle 26 is used to pass through the holes 27 on the bottom basket storage space 1, the handle 4, and the middle cover 19 respectively, and a plastic sleeve 26 with an edge is used to extend to a middle opening 38 of the middle cover 19 to cover and fix. If it is not firm, double-sided tape and screws can be used to fix it. A vertical concave basket 15 of the upper flower arrangement space, that is, a convex groove 29 of the middle concave basket cover 3 snaps with the groove 28 in the middle cover 19. If it is not strong enough, the double-sided tape and screws can be used to fix it. An outer surface of the vertical concave basket 15 is designed as a stepped flower bed type 13, that is, the ⅃ shape is used as the most basic unit to form the same shape as the vertical concave basket 15, and then the outer upper part of the vertical concave basket 15 is made of one or more such shapes, one is lower and larger than the other in a ladder connection manner, the front and rear ends are connected together, the size of each layer is customized, and the sizes of one to multiple layers can be the same or different. On the basis of the flower bed, flower lace decoration is added to form a stepped flower lace type 14, and the outside of the vertical concave basket 15 is collectively referred to as a flower bed and flower lace type small decoration platform.

Referring to FIG. 8, the bottom basket storage space 1 is fastened with the middle concave basket cover 3 through the side shallow grooves 30 and the side shallow convex groove 31 of the middle concave basket cover 3. In addition, double-sided tape or screws can be added for fixation. A double-sided mirror frame handle 4 is inserted into the flower arrangement space of the middle concave opening 5 of the middle concave basket cover 3, and then the magnetic buckle or T-shaped buckle 26 is used to pass through the holes 27 of the double-sided mirror frame handle 4 and the middle concave basket cover 3 and the plastic sleeve with an edge 26 is used to fix it. Double-sided tape or screws can be further added to fix it. The double-sided mirror frame handle 4 and a hand guard 39 are provided, and a polygonal frame 40 matched with the concave opening 5 is mounted on the flower arrangement space of the concave opening 5. When transforming into the box, as shown in the figures, the double-sided mirror frame handle 4 is equipped with a transparent thin plastic sheet 17, and the concave groove 29 around the bottom basket storage space 1 is embedded on a "U"-shaped bracket 33, and the "U"-shaped bracket has grooves 28 around it.

Referring to FIG. 10, the ⅃-shaped frame or the "L"-shaped frame 2 of the melon-shaped bottom basket storage space 1 is fit with the "L"-shaped surrounding edge 9 or the ⅃-shaped surrounding edge 9 of the middle concave basket cover 3. The magnetic buckle or T-shaped buckle 26 is used to pass through the holes 27 of the ⅃-shaped frame or the "L"-shaped frame of the melon-shaped bottom basket storage space 1 and on both sides of the handle 4 to sleeve with the plastic sleeve with an edge 26. The supporting edge 10 of the transparent melon-shaped upper convex cover 7 is placed on the ⅃-shaped surrounding edge 9 or the ⅃-shaped surrounding edge 9 of the middle concave basket cover 3 and together with the bottom basket storage space 1, so that it looks like a melon and fruit. A leaf shape or other various shapes at the bottom of the melon-shaped bottom basket storage space 1 extends downwards to form a U-shape 20.

Referring to FIG. 12 the ⅃-shaped frame or the "L"-shaped frame 2 of the bottom basket storage space 1 supports a desktop edge 35 of the middle concave basket cover 3. The side of the middle concave basket cover 3 has a support 32. The upper of the middle concave basket cover 3 is a soft desktop 23, the middle of the middle concave basket cover 3 is a flat desktop 6, and the flat desktop 6 can be designed with the flower arrangement 21 that is beneficial to manufacturing and non-infringement. The handle 4 is fixed with screws 34 on both sides of the soft decoration desktop type flower basket 23. The soft decoration is cloth or cloth-like material 36.

Referring to FIG. 14, the ⅃-shaped frame or the "L"-shaped frame 2 of the bottom basket storage space 1 in a lower half of a painting is attached to the "—"-shaped surrounding edge 9 or ⅃-shaped surrounding edge 9 of the middle concave basket cover 3, and the magnetic buckle or T-shaped buckle 26 is used to pass through the holes 27 of the ⅃-shaped frame or the "L"-shaped frame 2 of the bottom basket storage space 1 in the lower half of a painting and on both sides of the handle 4 to sleeve the plastic sleeve with an edge 26. The supporting edge 10 of the convex cover 7 on the transparent upper half of the painting is placed on the "—"-shaped surrounding edge 9 or ⅃-shaped surrounding edge 9 of the middle concave basket cover 3 to form a painting with the bottom basket storage space 1 of the lower half of the painting.

Referring to FIG. 16, the ⅃-shaped frame or the "L"-shaped frame 2 of the bottom basket storage space 1 supports the desktop edge 35 of the middle concave basket cover 3, and the outermost edge 37 of the middle concave basket cover 3 is a small decoration platform. The middle of the middle concave basket cover 3 is a flat desktop 6, and the entire desktop and sides are the hard decoration desktop 24. The flat desktop 6 can be designed to add a regular or a non-infringing shape 21 that is beneficial to manufacturing for flower arrangement, and the handle 4 is fixed with screws 34 on both sides of the hard decoration desktop 24.

The outside of the bottom basket storage space 1, the flower arrangement space of the middle concave basket cover 3, and the small decoration platform of each of the series of flower baskets can be decorated directly by the producer, or by the consumer as they wish according to the producer's raw materials.

What is claimed is:

1. A series of flower baskets, each flower basket characterized by comprising: a storage space, a flower arrangement space, a small decoration platform, and a handle, wherein a bottom basket is the storage space, and the small decoration platform is configured to be externally added; a total of eight flower baskets are provided based on a technical concept of creating the small decoration platform, including: a frame support small platform flower basket, a flower-leaf basket edge flower basket, a flower bed and flower lace flower basket, a double-sided mirror frame flower basket, an attractive melon and fruit flower basket, a soft decoration desktop flower basket and a hard decoration desktop flower basket; to connect the bottom basket storage space and the middle concave basket cover; the main connection methods are: supporting the basket cover by a frame, interlocking concave and convex grooves, and using a double-sided tape or screw for reinforcement; and the handle and the bottom basket storage space are connected to each other in a plurality of ways, to connect the handle and the bottom basket storage space; the main connection methods are:

using magnetic buckles, other fixed buckles, and fixing by screws and stud, and a shape and decoration of the handle is determined by a user.

2. The series of flower baskets according to claim 1, wherein an edge on a contour of a bottom basket storage space (1) of the frame support small platform flower basket is wider and higher than a basket body, the edge has a shape formed by using a ⅃ shape as a basic unit to surround an outer periphery of the bottom basket storage space, the edge is a frame (25), the user determines a size of each surface of the frame (25), an unconnected part of the frame (25) and the bottom basket storage space (1), the frame connected to the side where the bottom basket storage space (1) is not connected or connected in one of a straight line, or connected in one of an arc line, or connected in one of a mixed straight line and arc line, thereby forming a distinctive frame, the main connection method between the bottom basket storage space (1) and the middle concave basket cover (3) of the small platform flower basket is unique; a side of the middle concave basket cover (3) has a same shape as a top of a bottom basket storage space (1), a surrounding edge (9) or an ⅃-shaped surrounding edge (9) or a ⅃-shaped surrounding edge (9) vertical to the middle concave basket cover (3) is provided on the middle concave basket cover (3) to be placed on a ⅃-shaped frame or an ⅃-shaped frame (2) or on the "—"-shaped frame, the upper convex cover (7) is provided on a frame (25) of the bottom basket storage space (1) and the surrounding edge (9) of the middle concave basket cover (3), a supporting edge (10) is provided on the upper convex cover (7), the supporting edge (10) is either connected to the upper convex cover (7), or provide in another way by gluing to the surrounding edge (9) of the middle concave basket cover (3), and a small semicircle or square (11) is dug out or no dug is left on an edge of the upper convex cover (7) adjacent to the handle (4) so as to fit an arrangement of the handle (4).

3. The series of flower baskets according to claim 1, wherein an edge (8) is additionally provided on a periphery of a ⅃-shaped frame, or an ⅃-shaped frame (2) or a "—"-shaped frame of a bottom basket storage space (1) of the small platform flower basket, the edge (8) is one of turned up, or turned in one of the middle or down, or turned in one of straight or turned in a curled shape, the edge (8) be decorated in a variety of ways, and the user determines a size of each surface of the edge (8).

4. The series of flower baskets according to claim 1, wherein a middle part of the middle concave basket cover (3) having a flower shape of the flower basket edge type flower basket is a concave basket cover, and a shape of the concave basket cover is determined by the user; two or more petals or flowers or leaves or branches are connected to an outside of the cover, the two or more petals or flowers or leaves or branches are either a same size or spaced apart, a whole or part and a shape, a color and a type of the two or more petals or flowers or leaves or branches are uniform or non-uniform, and the middle concave basket cover (3) is smaller than and higher than a frame (25).

5. The series of flower baskets according to claim 1, wherein an upper layer flower concave basket cover (18) of the flower basket edge type flower basket or a concave basket in a flower vertical frame (12) is smaller than and higher than a middle layer, and a periphery is also connected with two or more petals or flowers or leaves or branches and leaves; a shape, a number and a distribution of the two or more petals or flowers or leaves or branches and leaves are consistent with or slightly less than those on the middle concave basket cover (3) having a flower shape, or slightly smaller or a same size as the leaves on the middle concave basket cover (3) having the flower shape, and shapes thereof are determined by the user according to needs, such as shapes that are turned up or down or horizontal or connected or layered or turned over or a mixture of the method mentioned above, and patterns and shapes slightly exaggerated or modified to be anthropomorphic or imitative are determined by the user according to needs; a bottom of the upper layer flower concave basket cover (18) is removed and turned into a vertical plug or bent into a groove or a flat surface so as to form the flower vertical frame (12); one to five layers of flower concave basket covers are added to the upper layer flower concave basket cover (18) or the flower vertical frame (12) in sequence according to the upper layer or the middle layer, such as that a number of flowers outside a cover edge is reduced each layer, the flower concave basket cover or the flower vertical frame is higher in one layer than another layer, or a number of flowers outside a cover edge is smaller in shape than each other, or the flower concave basket cover or the flower vertical frame is higher in one layer than another layer.

6. The series of flower baskets according to claim 1, wherein a central opening of a middle cover (19) of a middle layer of the flower bed and flower lace type flower basket is circular, quadrilateral, heart-shaped, flower-shaped or a simple symmetrical shape, and to facilitate manufacturing, a shape of the middle cover (19) is determined by the user so as to act as a support for the upper layer; a center of an upper concave basket of the flower bed and flower lace type flower basket is a vertical concave basket (15) that is small circular, quadrilateral, heart-shaped, flower-shaped or simple symmetrical vertical, which is selected in order to benefit for manufacturing; the vertical concave basket (15) is further used as the middle concave basket cover (3) and an outside is designed as a stepped flower bed (13); that is, the ⅃ shape is used as a most basic unit to form a same shape as the vertical concave basket (15), then an outer upper part of the vertical concave basket (15) is made of one or more such shapes, one is lower and larger than another in a ladder connection manner, a front end and rear end are connected together, a dimension of each layer and each surface are determined by the user, and each surface size of one or more layers is the same or different; on a basis of the flower bed, a lace decoration is added to form a stepped flower lace (14), and an outside of the vertical concave basket (15) forms a flower bed and flower lace type decoration platform (16); and existing landscape stepped flower bed shape is suitable for the stepped flower lace.

7. The series of flower baskets according to claim 1, wherein the middle concave basket cover (3) having a concave opening (5) for the flower arrangement space is provided and fixed on an opening of a bottom basket storage space (1) of the double-sided mirror type flower basket; a concave opening (5) is provided in the middle of the middle concave basket cover (3) of the double-sided mirror type flower basket, the opening is one of symmetrical or asymmetrical shapes that is beneficial to manufacturing; two middle edges of the opening are long straight edges or long folded edges or curved edges or any combination of straight edges, curved edges, and folded edges; two edges for installation of the handle (4) extend downward into a shape that is combined with lower parts of both sides of a third part of the handle (4); and the shape is beneficial to manufacturing without affecting installation of the handle (4), and the lower parts are not sealed; the double-sided mirror type flower basket is configured to be transformed into a box, and when a transparent thin plastic sheet (17) is correspondingly installed on both sides of the handle, the double-sided mirror type flower basket is transformed into a box without sealing the bottom, or a convex groove (29) is provided inward on all sides to be embedded in a "U" shaped frame (33) with a same shape as a bottom basket or in a groove (28) around the "U" shaped frame (33); the transparent thin plastic sheet (17) is decorated in a plurality of ways, mainly by printing, relief, stickers, and openwork carving.

8. The series of flower baskets according to claim 1, wherein an opening of the handle (4) of the double-sided mirror type flower basket is provided on inside or outside or on both sides or on one side or on a plurality of sides, each opening is provided with a certain height and width that forms the flower arrangement space, and is an outline or a most part of an outline of a tangible object, or is solid, a lower part is deformed or a main trunk on two sides is extended downward, and a shape is such that the two edges of the handle (4) extending downward are brought together and finally inserted and fixed into a concave opening (5).

9. The series of flower baskets according to claim 1, wherein a middle part of a bottom basket storage space (1) of the attractive melon and fruit type flower basket is a bottom part of a melon and fruit shape, a bottom edge of the melon and fruit shape extends outward to form one of square, circle, flower shape, leaf shape and other various shapes, or further downwards to form a "⊓" shape (20), or both sides are inclined inward or outward; the shapes are non-infringing and beneficial to manufacturing, and the size is determined by the user to ultimately form the small decoration platform.

10. The series of flower baskets according to claim 1, wherein an upper convex cover (7) of the attractive melon and fruit type flower basket is a transparent cover, a color of the upper convex cover (7) is determined by the user, and a shape of the upper convex cover (7) is another half of the melon and fruit shape; the upper convex cover (7) cooperates with a bottom basket storage space (1) to form a shape of cut melon and fruit placed on an object, that is very attractive; the upper convex cover (7) is provided with a supporting edge (10), and the supporting edge (10) is provided on the upper convex cover (7), or is separately attached to the middle concave basket cover (3), and a size is determined by the user to form the small decoration platform.

11. The series of flower baskets according to claim 1, wherein a circular edge that is slightly wider than a side of a basket body is provided on a bottom basket storage space (1) of the soft decoration desktop type flower basket, the circular edge is a "⊥"-shaped frame, or an "⊥"-shaped frame (2) or a ""—" "-shaped frame, and a dimension of a frame (25) is determined by the user; a concave shape in a middle of the middle concave basket cover (3) is either directly placed on the frame (25) parallel to a bottom surface of the frame (25), or sides thereof are consistent with and attach to an upper part of the bottom basket storage space (1), or is fitted into the bottom basket according to the decoration, and a depth of the concave shape is determined by the user according to a situation; a bottom is like a desktop so as to be called as a flat desktop (6), a middle part is either a plane, or an opening provided on the plane and the opening on the plane is configured for an insertion of an object; the object (21) is formed independently and then inserted into a hole or connected to a desktop to form an integrated body, and any object which is beneficial to manufacturing and able to be used as a flower arrangement space and connected to the desktop is the object (21).

12. The series of flower baskets according to claim 1, wherein an edge of a flat desktop (6) of the soft decoration desktop type flower basket is a "⊥"-shaped frame that is consistent with and attached to a "⊥"-shaped frame, or an "⊥"-shaped frame (2) or a ""—" "-shaped frame; a highest outer side of a desktop side (35) is connected by straight lines or arcs or a mixture of straight lines and arcs, and is a same size as or wider than a highest side of a frame (25); an outermost edge (37) is added to an outermost side of the desktop, and the outermost edge (37) is vertical to a highest edge of the desktop or closely connected to the highest edge to create a non-vertical shape, and a size thereof is determined by the user; a support (32) is provided to support a peripheral soft decoration flower lace; cloth and a cloth material (36) is sleeved or glued on an outer surface of an entire middle concave basket cover, and the above are collectively referred to as the soft decoration desktop type flower basket (23).

13. The series of flower baskets according to claim 1, wherein two sides of a bottom basket storage space (1) of the clever collage type flower basket are a lower half of a painting, that is the small decoration platform; an edge that is slightly wider than a basket body is provided on the bottom basket storage space (1); the edge is a "⊥"-shaped frame, or an "⊥"-shaped frame (2) or a ""—" "-shaped frame, the frame is only a quadrilateral, either straight or curved or folded, and a size of the edge is determined by the user, and the above is a second small decoration platform.

14. The series of flower baskets according to claim 1, wherein a shape of two sides of the upper convex cover (7) of a transparent upper half of the clever collage type flower basket is a transparent upper half of a painting, and the shape cooperates with a bottom basket storage space (1) of a lower half of the painting to form a painting with a supporting edge (10); the supporting edge (10) is directly attached to the upper convex cover (7), or is separately glued to the middle concave basket cover (3), and a size thereof is determined by the user; the painting is a flat painting or a relief painting or an openwork painting, the two sides of the bottom basket storage space (1), the middle concave basket cover (3), and the upper convex cover (7), that is, two sides of the handle, are flat, obliquely straight, or arc-shaped, or consistent with an edge of the picture.

15. The series of flower baskets according to claim 1, wherein an edge that is slightly wider and higher than a basket body is provided on a bottom basket storage space (1) of the hard decoration desktop type flower basket, the edge is a "⊥"-shaped frame or an "⊥"-shaped frame (2) or a " "—" "-shaped frame, and a size of each surface of a frame (25) is determined by the user; each surface of the frame (25) is a plane or a groove (41) for fixation and decoration; a concave shape in a middle of the middle concave basket cover (3) is either directly placed on the frame (25) parallel to a bottom surface of the frame (25), or sides thereof are consistent with and attach to an upper part of the bottom basket storage space (1), or is fitted into the bottom basket according to decoration, and a depth of the concave shape is determined by the user according to a situation; a bottom of the middle concave basket cover (3) is like a desktop so as to be called as a flat desktop (6), a middle part is either a plane, or an opening provided on the plane and the opening on the plane is configured for an insertion of an object; the object (21) is formed independently and then inserted into the hole or connected to a desktop to form an integrated body, and any object which is beneficial to manufacturing and able to be used as a flower arrangement space and connected to the desktop is the object (21); an edge of the flat desktop (6) of the hard decoration desktop type flower basket is a "ㄴ"-shaped frame that is consistent with and attach to the ""—""-shaped frame or the "ㄴ"-shaped frame (2) or the ""—""-shaped frame; a highest outer side of a desktop side (35) is connected by straight lines or arcs or a mixture of straight lines and arcs, and is a same size as or wider than a highest side of the frame (25); an outermost edge (37) is added to an side edge of the desktop, and the outermost edge (37) is vertical to the highest edge of the desktop or closely connected to a highest edge to create a non-vertical shape, and a size thereof is determined by the user; a support (32) is provided to support a peripheral soft decoration flower lace; an entire desktop and a vertical edge of the desktop are decorated directly on a material and the above are collectively referred to as a hard decoration desktop (24).

* * * * *